US005662213A

United States Patent [19]

Kattler et al.

[11] Patent Number: 5,662,213

[45] Date of Patent: Sep. 2, 1997

[54] TRIM SWITCH WITH WATERPROOF BOOT

[75] Inventors: David R. Kattler, Mantua; Peter J. Trimble, Jr., Eastlake, both of Ohio

[73] Assignee: Delta Systems, Inc., Streetsboro, Ohio

[21] Appl. No.: 610,379

[22] Filed: Mar. 4, 1996

[51] Int. Cl.[6] ..... H01H 19/06

[52] U.S. Cl. ..... 200/302.3; 200/6 R

[58] Field of Search ..... 200/6 R, 302.3, 200/339

[56] References Cited

U.S. PATENT DOCUMENTS

| | | | |
|---|---|---|---|
| 3,320,389 | 5/1967 | Arlauskas . | |
| 3,668,938 | 6/1972 | Dimitry . | |
| 3,898,397 | 8/1975 | Devore et al. . | |
| 3,928,742 | 12/1975 | Rule | 200/302.3 |
| 4,127,754 | 11/1978 | Josemans et al. . | |
| 4,169,972 | 10/1979 | Black, III et al. . | |
| 4,181,825 | 1/1980 | Epple . | |
| 4,283,611 | 8/1981 | Bull . | |
| 4,340,791 | 7/1982 | Sorenson | 200/302.3 |
| 4,454,391 | 6/1984 | Olsson . | |
| 4,777,333 | 10/1988 | Valenzona . | |
| 4,851,619 | 7/1989 | Fujita et al. . | |
| 4,874,911 | 10/1989 | Parrish . | |
| 4,924,046 | 5/1990 | Howard . | |
| 4,937,407 | 6/1990 | Osika | 200/302.3 |
| 4,947,008 | 8/1990 | Sato et al. . | |
| 4,947,461 | 8/1990 | Yoshioka et al. | 200/6 R |
| 5,053,591 | 10/1991 | Theurer . | |
| 5,095,409 | 3/1992 | Dematteo et al. | 200/315 |
| 5,239,143 | 8/1993 | Valenzona . | |
| 5,265,716 | 11/1993 | Sawada et al. . | |
| 5,343,007 | 8/1994 | Roeser et al. . | |
| 5,380,972 | 1/1995 | Lunak et al. . | |

OTHER PUBLICATIONS

One page from a catalog published by Ark-Les Corp. of Watertown, MA, publication date unknown. To the best of Applicants' knowledge the date of publication was more than one year prior to the filing date of the present application, namely Mar. 4, 1996.

*Primary Examiner*—Stuart N. Hecker

*Attorney, Agent, or Firm*—Watts, Hoffmann, Fisher & Heinke, Co., L.P.A.

[57] ABSTRACT

A trim switch for mounting in an opening in an outboard motor cowl is disclosed. The trim switch includes an outer housing which overlies a rocker assembly. The rocker assembly includes a rocker and a rocker support housing. The rocker support housing defines an interior region in which terminals and a terminal bridging contact are disposed. A cup-shaped waterproof boot overlies the rocker assembly and is sandwiched between the outer housing and the rocker assembly. The boot prevents water from leaking between the rocker and the rocker support housing and provides a positive seal between the outer housing the rocker assembly.

13 Claims, 5 Drawing Sheets

TRIM SWITCH WITH WATERPROOF BOOT

FIELD OF THE INVENTION

The present invention relates to a trim switch for an outboard motor and, more particularly, to an improved trim switch having a cup-shaped waterproof boot overlying a rocker assembly including a rocker and a rocker support housing to prevent water from leaking between the rocker and the rocker support housing and entering an interior region of the housing.

BACKGROUND OF THE INVENTION

An outboard motor trim switch is used in connection with pivoting an outboard motor mounted on a stern of a boat between an upright operating position and an angled trailering position. The trim switch is mounted in an opening in a cowl of the outboard motor. The cowl is a cover which encloses the top or engine portion of the outboard motor. The trim switch is electrically coupled to a battery and a reversible motor. When actuated, the trim switch closes the circuit between the battery and the reversible motor causing a shaft of the reversible motor to rotate in either a clockwise or counterclockwise direction. The shaft, in turn, is mechanically coupled to a gear drive. As the shaft rotates, the gear drive pivots the outboard motor to either raise the motor from the operating position to the trailering position or lower the motor from the trailering position to the operating position.

In the trailering position, the outboard motor is angled such that a lower portion of the motor including a propeller is positioned slightly away from the boat stern and vertically above its operating position level. In the trailering position, the propeller and lower portion of the motor are out of the way as the boat is slid onto or off of a trailer. In addition to using the trim switch to raise the outboard motor for trailering, the trim switch may be actuated while the boat is in the water to raise the propeller to facilitate untangling lines, tree roots, etc. which may become wrapped around the motor propeller during operation of the boat.

Generally, a trim switch comprises a three position momentary rocker switch having an actuator or rocker which rocks or pivots between the three positions. In the center or neutral rocker position, the trim switch is open and the reversible motor is off. In one of the two off center rocker positions, the switch is actuated or closed to bridge a set of terminals. Bridging the terminals energizes the reversible motor to rotate the shaft is a clockwise direction. In the other of the two off center rocker positions, the switch is closed to bridge a different set of terminals energizing the reversible motor to rotate the shaft in a counterclockwise direction. When the shaft rotates in one direction, the gear drive pivots the outboard motor upwardly to the trailering position. When the shaft rotates in the opposite direction, the gear drive pivots the outboard motor downwardly to the operating position. The trim switch additionally includes an outer housing, which is secured with a clip to the outboard motor cowl to hold the trim switch in position, and a rocker support housing which supports the pivoting rocker and defines an interior region in which terminals and a terminal bridging contact are disposed.

A trim switch is susceptible to having water splashed against it because of its position on the outboard motor cowl. If water leaks between the rocker and the rocker support housing and enters the housing interior region, serious problems may result. Water in the rocker support housing interior may result in short circuiting two or more terminals possibly burning out the trim switch and/or the reversible motor. Even if short circuiting does not occur, the water may cause corrosion of the terminals or the terminal bridging contact. In either case, the operational life of the trim switch may be adversely effected.

SUMMARY OF THE INVENTION

An improved trim switch is disclosed. The trim switch includes an outer housing and a rocker assembly which fits within an interior region of the outer housing. The outer housing is securable to a cowl of an outboard motor. The rocker assembly includes a rocker, a rocker support housing, a terminal bridging assembly, and a terminal support. The rocker support housing supports the rocker for pivoting movement between a center position and two off center positions. The rocker support housing defines an interior region in which the terminal bridging assembly and the terminal assembly are supported. The terminal bridging assembly includes a terminal bridging contact while the terminal assembly includes a terminal frame and three terminals including a center ground terminal.

The trim switch of the present invention features a one piece cup-shaped waterproof boot that overlies the rocker assembly. The boot is resiliently deformable and durable and is preferably made of SANTOPRENE™ by Monsanto Chemical Company. The boot prevents water leakage between the rocker and the rocker support housing. Thus, water cannot enter the rocker support housing interior region and corrode or short circuit the terminals and/or the terminal bridging contact supported therein. Additionally, the boot is sandwiched between the outer housing of the trim switch and the rocker assembly thereby providing a positive seal between the outer housing and the rocker assembly.

The terminal bridging assembly of the present invention features the terminal bridging contact translating or moving substantially horizontally to bridge the center terminal and one of the outer terminals of the terminal assembly when the rocker is depressed to one of the two off center positions. The terminal assembly includes the center ground terminal and two outer terminals flanking opposite sides of the center terminal. In the rocker's center position, the terminal bridging contact is disposed on an upper surface of the center terminal. When a right end portion of the rocker is depressed, the terminal bridging contact moves horizontally to the left to contact an upper surface of the outer terminal to the left of the center terminal thereby bridging the left of center outer terminal and the center terminal. Similarly, when a left end portion of the rocker is depressed, the terminal bridging contact moves horizontally to the right to contact an upper surface of the outer terminal to the right of the center terminal thereby bridging the right of center outer terminal and the center terminal. The horizontal movement of the terminal bridging contact provides a more positive electrical connection between the bridged terminals and, as the terminal contact moves across upper contact surfaces of the terminals, it provides a cleaning action to the those contact surfaces.

One object of the present invention is to provide a trim switch for an outboard motor which includes a protective boot overlying a rocker assembly including a rocker and a rocker support housing to prevent water from leaking between the rocker and the rocker support housing and into an interior region defined by the rocker support housing.

Another object of the present invention is to provide a trim switch which includes a protective boot sandwiched between an outer housing and a rocker assembly overlied by the outer housing to prevent water from seeping between the outer housing and the rocker assembly.

Yet another object of the present invention is to provide a trim switch which includes a terminal bridging contact which translates substantially horizontally to bridge two terminals thereby providing a positive electrical connection between the bridged terminals and a cleaning action with respect to the contact surfaces of the bridged terminals.

This and other objects, advantages and features of the invention will become better understood from a detailed description of a preferred embodiment of the invention which is described in conjunction with the accompanying drawings.

DETAILED DESCRIPTION

Figure 1:
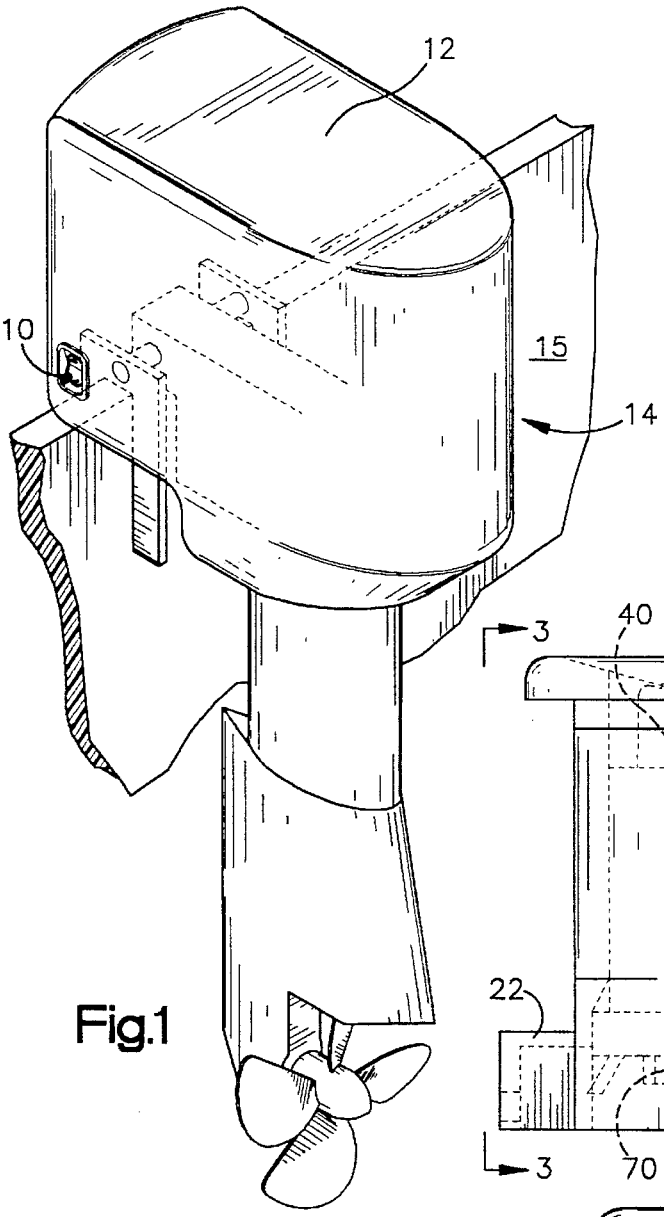
FIG. 1 is a perspective view of a trim switch of the present invention mounted in an opening in a cowl of an outboard motor.

Turning to the drawings, a trim switch of the present invention is shown generally at 10 in FIG. 1. The trim switch 10 is mounted in an opening in a cowl 12 of an outboard boat motor 14 and is electrically coupled between a battery (not shown) and a reversible electric motor (not shown). The outboard boat motor 14 is mounted on a stern 15 of a boat. An output shaft of the reversible electric motor is coupled to a gearing assembly (not shown) to arcuately move or tilt the outboard motor 14 with respect to the stern 15 between an upright operating position (shown in FIG. 1) and an upwardly angled trailering position (not shown).

Figure 7:
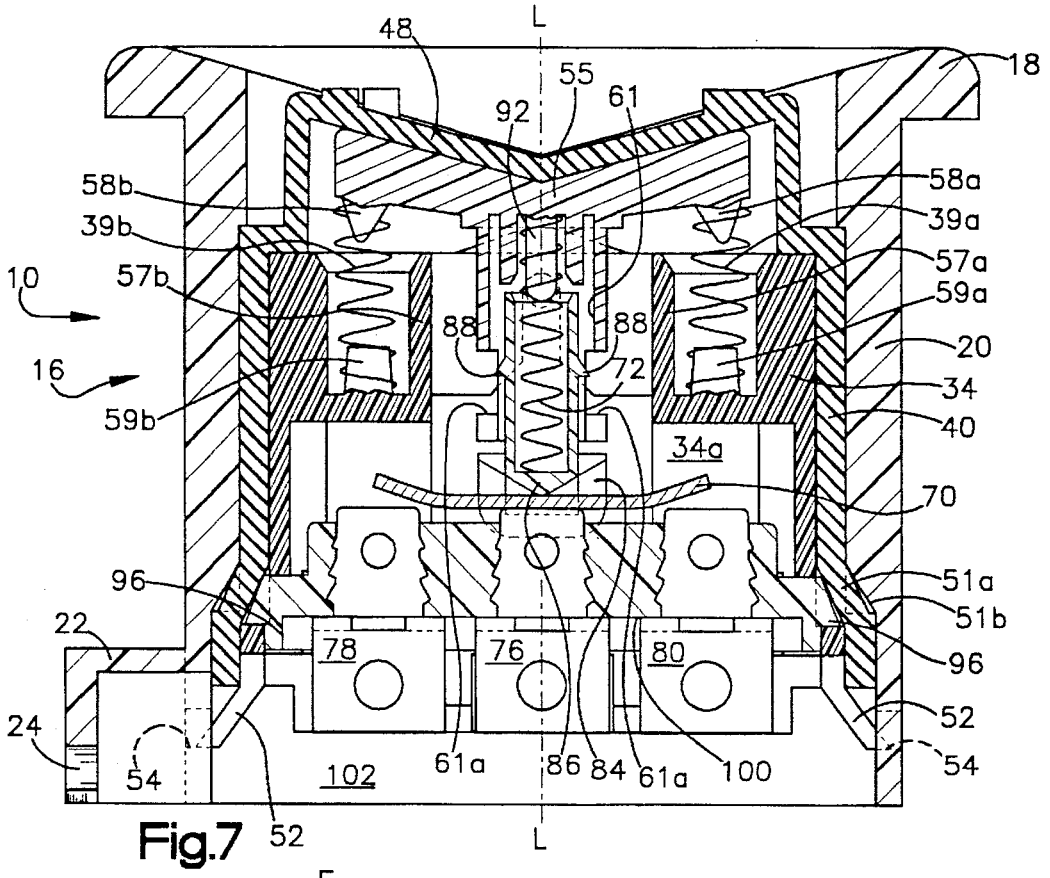
FIG. 7 is a sectional view of the trim switch of FIG. 1 showing a rocker in a center position.
Figure 8:
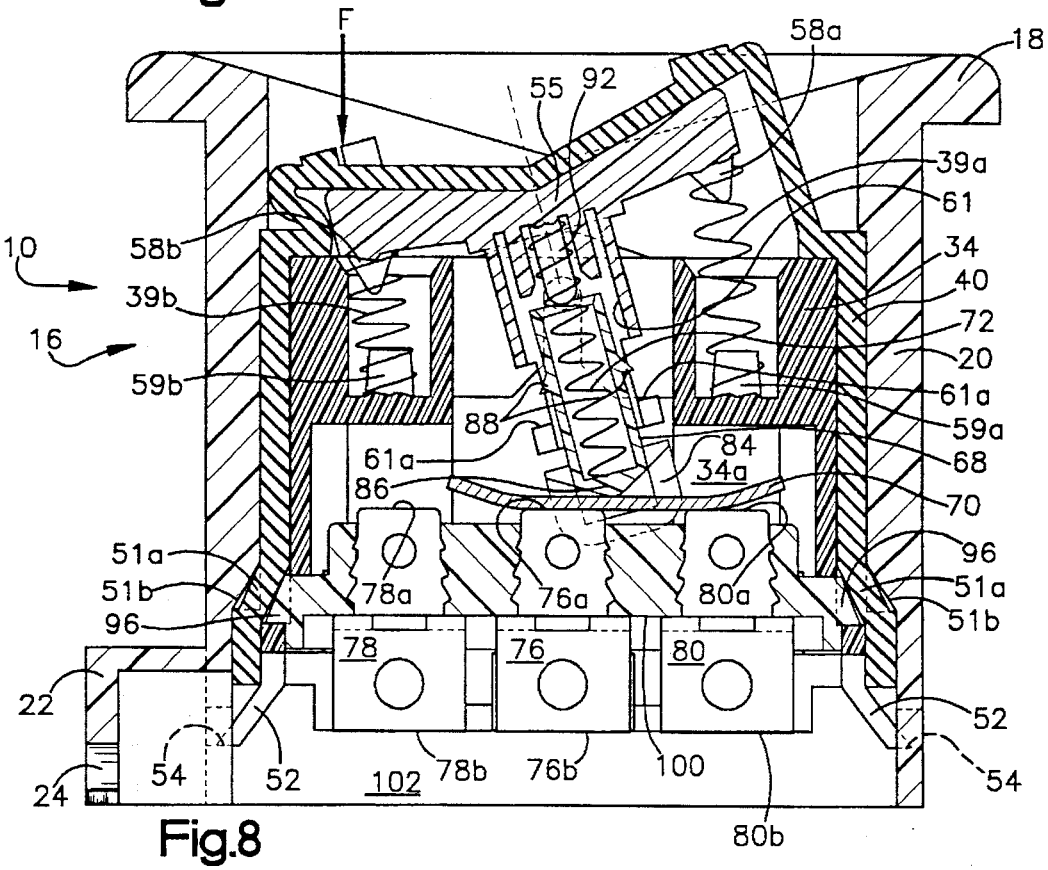
FIG. 8 is a sectional view of the trim switch of FIG. 1 showing the rocker in an off center position with a terminal bridging contact bridging a center ground terminal and a terminal disposed to the left of the center terminal.

The tilt switch 10 includes a rocker 32 which pivots between three positions; a center position (shown in FIG. 7) and two off center positions (one of which is shown in FIG. 8). In the center rocker position, the trim switch 10 is open and the reversible motor is off. In one of the two off center rocker positions, the trim switch 10 closes one circuit path between the battery and the reversible electric motor causing the motor shaft to rotate in a clockwise direction. In the other of the two off center rocker positions, the trim switch 10 closes a second circuit path between the batter and the reversible motor causing the motor shaft to rotate in a counterclockwise direction. Clockwise rotation of the motor shaft causes the gearing assembly to raise the outboard motor 14 from the operating position to the trailering position, while counterclockwise rotation of the motor shaft causes the gearing assembly to lower the outboard motor from the trailering position to the operating position.

Figure 2:
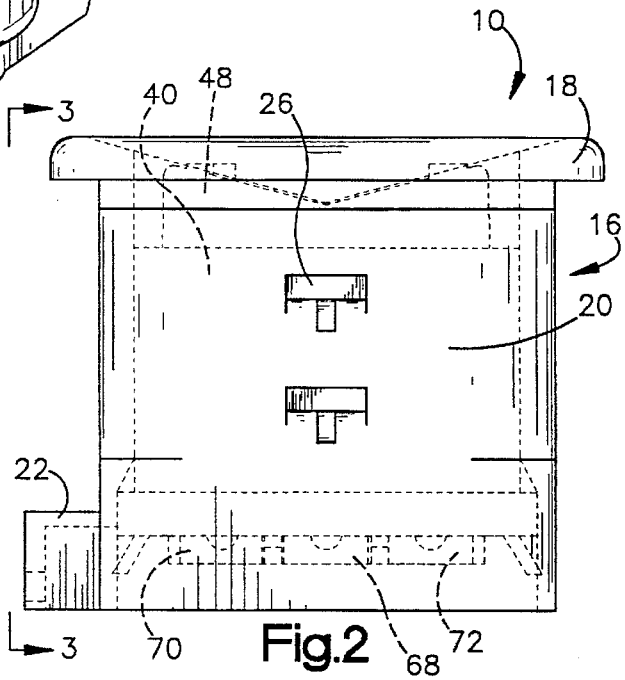
FIG. 2 is a front elevation view of the trim switch of FIG. 1.
Figure 3:
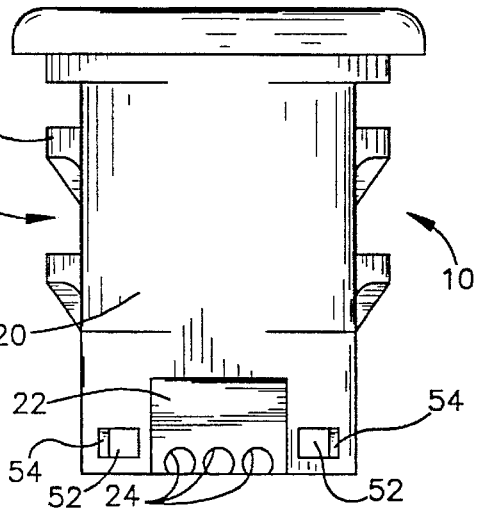
FIG. 3 is a side elevation view of the trim switch of FIG. 1 as seen from a plane indicated by the line 3—3 in FIG. 2.

The trim switch 10 includes an outer housing 16 (best seen in FIGS. 2–5) which includes an upper portion 18 and a central body 20. As can best be seen in FIGS. 5 and 5A, the outer housing upper portion 18 extends outwardly from the central body 20. An inner surface 21 of the outer housing upper portion 18 and the outer housing central body 20 define a hollow interior region that is generally rectangular in cross section. The central body 20 includes a extending lower portion 22 having three longitudinal openings 24 in communication with the interior region. The longitudinal openings 24 accommodate three wires (not shown) which are appropriately coupled between the battery and the reversible electric motor. As can best be seen in FIG. 1, the outwardly extending upper portion 18 of the outer housing 16 seats against an outer surface of the cowl 12 surrounding the opening. The outer housing 16 is secured to the cowl 12 with a copper clip which is disposed between an inner surface of the cowl and a pair of arms 26 (FIGS. 2, 3 and 4) extending outwardly from an outer surface of the central body 20. The outer housing 16 is preferably comprised of a durable, high impact plastic such as polypropylene.

Figure 4:
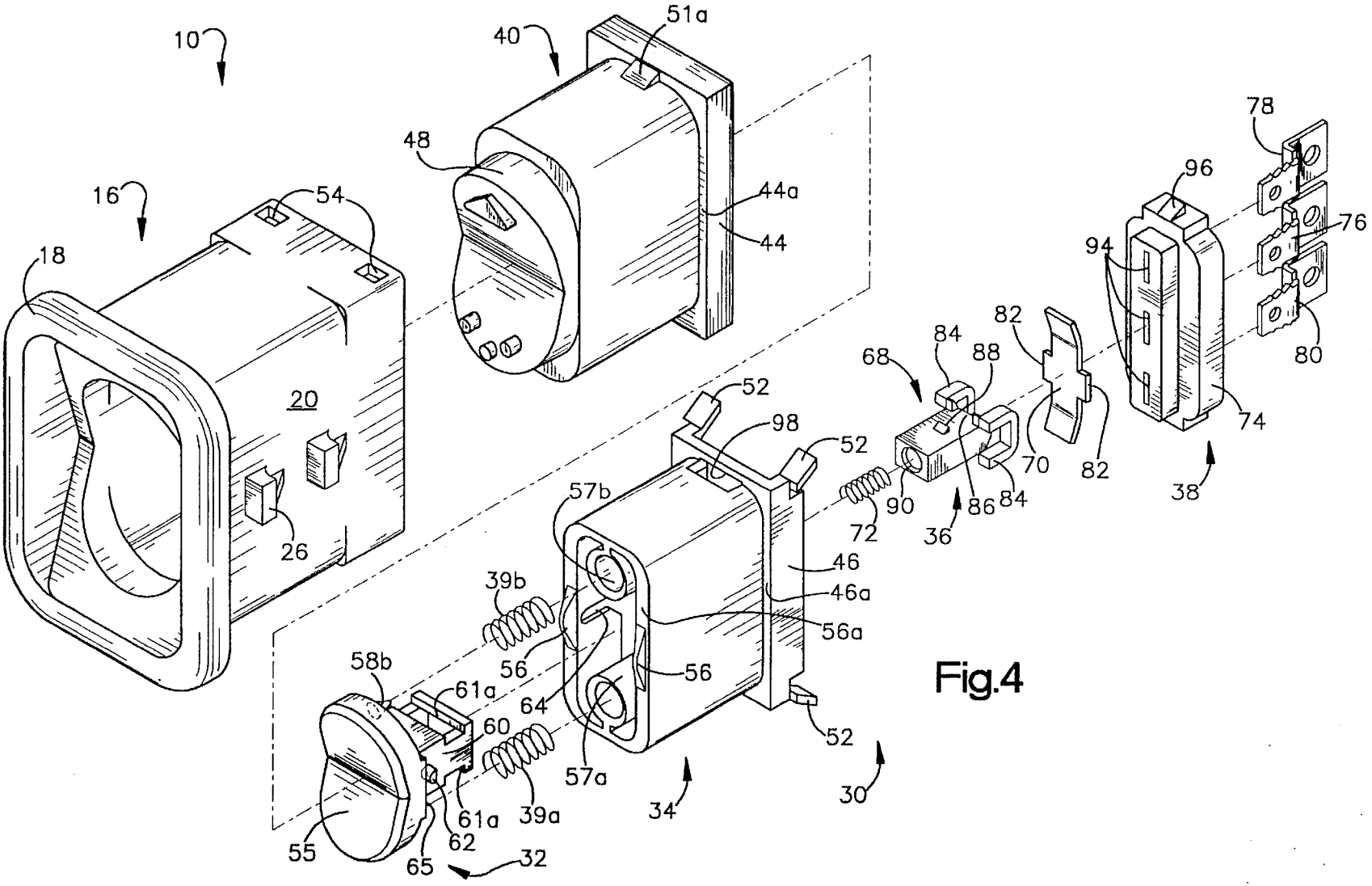
FIG. 4 is an exploded assembly view of the trim switch of FIG. 1.
Figure 6:
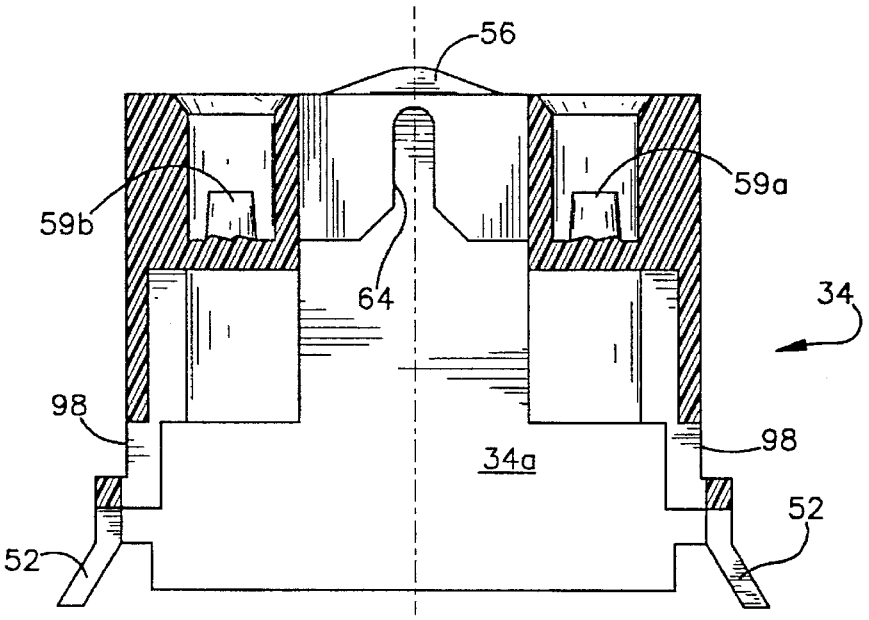
FIG. 6 is a sectional view of a rocker support housing of the trim switch of FIG. 1.

As can best be seen in FIG. 4, sized to fit within the outer housing interior region is a rocker assembly 30. The rocker assembly 30 is comprised of the rocker 32, a rocker support housing 34, a terminal bridging assembly 36 and a terminal assembly 38. The terminal bridging assembly 36 and the terminal assembly 38 are supported within an interior region 34*a* (FIGS. 6, 7 and 8) of the rocker support housing 34. The rocker support housing 34 and a pair of coil springs 39*a*, 39*b* support the rocker 32 for pivoting movement between the aforementioned three positions. The rocker support housing 34 and the rocker 32 are preferably comprised of polypropylene plastic.

As can best be seen in FIGS. 7 and 8, overlying the rocker assembly 30 and sandwiched between the inner surface 21 of the outer housing 16 and the rocker assembly 30 is a cup shaped waterproof boot 40. The boot 40 is resiliently deformable and durable and preferably is molded from a material sold in pelletized form by Monsanto Chemical Company under the brand name SANTOPRENE™. The boot 40 may be fabricated through an injection molding process well known to those skilled in the art. The boot 40 prevents water from entering the interior region 39 of the rocker support housing 34. Additionally, there is a snug fit between the boot 40 and the inner surface 21 of the outer housing 16 which minimizes water seepage between the outer housing and the boot.

Figure 5:
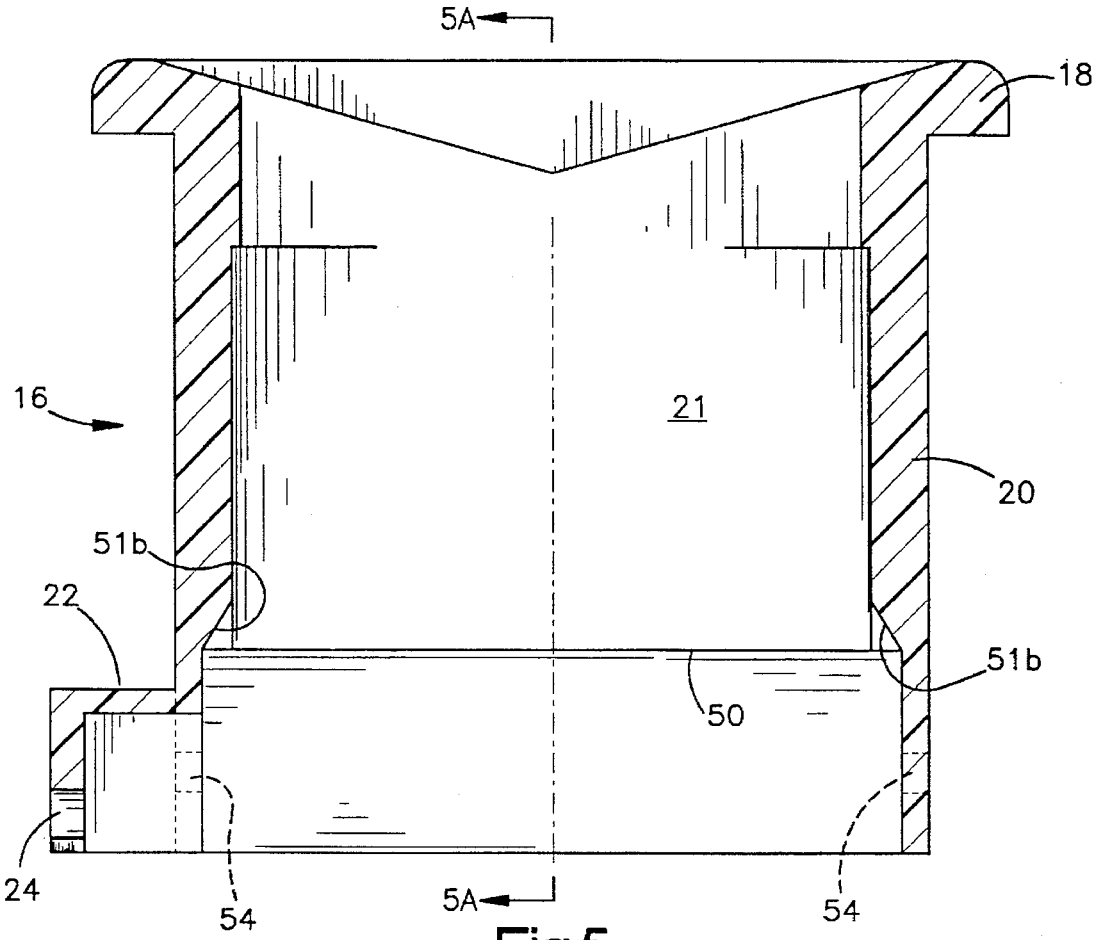
FIG. 5 is a sectional view of an outer housing of the trim switch of FIG. 1.
Figure 5A:
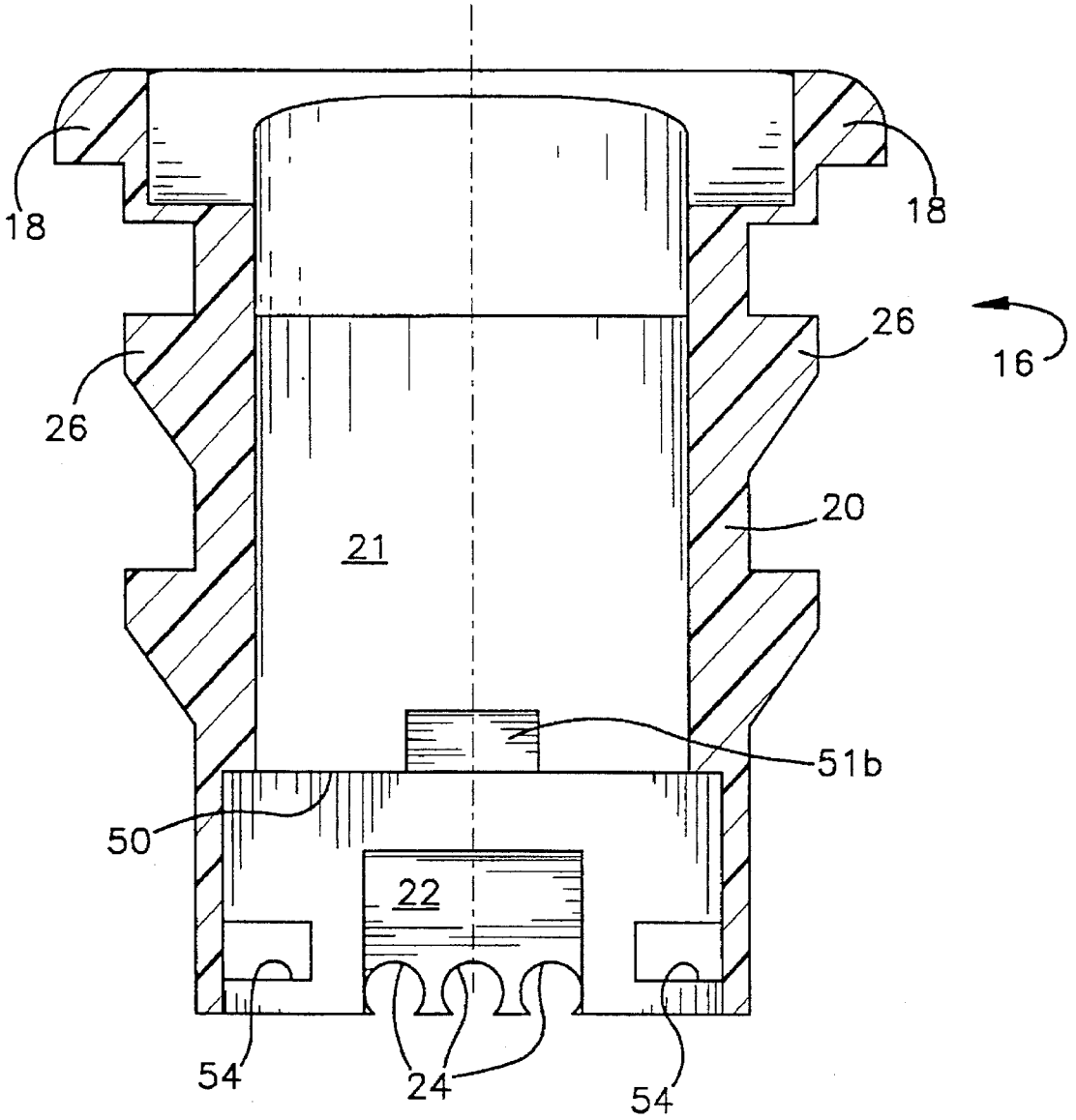
FIG. 5A is another sectional view of the outer housing of FIG. 5.

As can best be seen in FIG. 4, the boot 40 includes an outwardly stepped lower portion 44 which overlies an upper part of a correspondingly outwardly stepped lower portion 46 of the rocker support housing 34. When the boot 40 and rocker support housing 34 are inserted into the outer housing interior region 21 upper surfaces 44*a*, 46*a* of the outwardly stepped lower portions 44, 46 of the boot 40 and rocker support housing 34 seat against a corresponding peripheral lip 50 formed in the inner surface 21 of the outer housing 16. The lip 50 is seen in FIGS. 5 and 5A. Furthermore, a pair of wedge shaped sections 51*a* (FIGS. 4, 7 and 8) extending from the upper surface 44*a* of the boot 40 seat against corresponding inclined portions 51*b* (FIGS. 5, 5A, 7 and 8) of the outer housing inner surface. The rocker support housing lower portion 46 includes four radially outwardly extending securement nubs 52 (FIGS. 4, 6, 7 and 8). When the rocker support housing 34 is inserted into the outer housing 16, the nubs 52 snap fit into corresponding openings 54 (FIGS. 3 and 4) in a lower portion of the outer housing central body 20 to secure the rocker support housing 34 and the boot 40 in place within the outer housing interior region. Further, the boot 40 is prevented from moving upwardly in the outer housing interior region because of the aforementioned seating of the boot upper surface 44*a* on the outer housing peripheral lip 50.

When the trim switch 10 is assembled, an upper portion 48 of the boot 40 overlies an upper portion 55 (FIGS. 4, 7 and 8) of the rocker 32. When a force F (FIG. 8) that is offset to a central axis L—L of the trim switch 10 is applied to the boot 40, the boot upper portion 48 deforms and the rocker 32 pivots on two arcuate raised portions 56 (FIG. 4) extending from an upper surface 56*a* of the rocker support housing 32 to one of the rocker's two off center positions. When the force F is removed, the rocker 32 returns to the center position (FIG. 7) due to a biasing force applied by the coil springs 39*a*, 39*b*. The coil springs 39*a*, 39*b* are supported in respective central longitudinal openings of cylindrically shaped supports 57*a*, 57*b* (FIGS. 4, 6, 7 and 8) extending inwardly from the rocker support housing inner wall 34*a*. Ends of the coil springs 39*a*, 39*b* engage nubs 58*a*, 58*b* (FIGS. 4, 7 and 8) extending downwardly from a lower surface of the rocker upper portion 55 and corresponding nubs 59*a*, 59*b* (FIGS. 7 and 8) extending upwardly into the central openings defined by the cylindrically shaped supports 57*a*, 57*b*. Although FIG. 8 shows the rocker 32 in one of its two off center positions, it should be understood that the force F could be applied to the other side of the rocker causing it to pivot to the other of the two off center positions. A lower portion 60 (FIG. 4) of the rocker 32 is rectangularly shaped and includes a central cavity 61 (FIGS. 7 and 8) and a pair of rectangularly shaped openings 61*a* (FIGS. 4, 7 and 8) in opposite sides of the lower portion.

Two tapered extensions 62 (only one of which can be seen in FIG. 4) extend outwardly from an outer surface of the rocker lower portion 60. During assembly of the trim switch 10, the rocker lower portion 60 is pushed into an opening in the upper surface 56*a* of the rocker support housing 34 between the pair of cylindrically shaped supports 57*a*, 57*b*. The two tapered extensions 62 of the rocker lower portion 60 slightly deflect the rocker support housing 34 as the rocker lower portion 60 is inserted into the rocker support housing. As the rocker lower portion 60 continues to be inserted into the rocker support housing 34, the two tapered extensions 62 snap into respective slot shaped indentations 64 (FIGS. 4 and 6) in the inner surface 34*a* of the rocker support housing. Further, flat portions 65 (only one of which can be seen in FIG. 4) on the bottom surface of the rocker upper portion contact the rocker housing arcuate raised portions 56. As the rocker 34 pivots, the flat portions 65 rock on the rocker housing arcuate raised portions 56 and the tapered extensions 62 rotate in an upper end of their respective indentations 64. The engagement of the tapered extensions 62 in the slot shaped indentations 64 and the contact between the flat portions 65 and the arcuate raised portions 56 function to pivotably secure the rocker 32 to the rocker support housing 34.

As can be seen in FIG. 4, the terminal bridging assembly 36 includes a terminal contact support 68, a terminal bridging contact 70 and a biasing coil spring 72. The terminal assembly 38 includes a terminal frame 74 and a copper center ground connection terminal 76 flanked on either side by outer terminals 78, 80. Preferably, the terminal frame 74 is comprised of polypropylene plastic. The terminal bridging contact 70 is comprised of a conductive material preferably copper and includes side extensions 82 (FIG. 4) which slidingly interfit in square openings defined by U-shaped members 84 extending from a bottom end 86 of the terminal contact support 68. As can best be seen in FIGS. 7 and 8, the terminal contact support bottom end 86 is bullet shaped and pushes downwardly on the terminal bridging contact 70.

As can be seen in FIGS. 4, 7 and 8, a pair of tapered extensions 88 extend from an outer surface of the terminal contact support 68. The terminal contact support 68 includes a central longitudinal opening 90 in which the biasing spring 72 is disposed. During assembly, the terminal contact support 68 is pushed into the central opening 61 of the rocker lower portion 60. As the tapered extensions 88 are pushed against rocker lower portion 60, the rocker lower portion deflects slightly outwardly. As the terminal contact support 68 is pushed further into the central opening 61 of the rocker lower portion 60, the tapered extensions 88 snap outwardly into respective rocker lower portion side openings 61*a*. The terminal contact support 68 slidingly moves within the rocker lower portion central opening 61. A path of travel of the terminal contact support 68 is limited to a distance the tapered extensions 88 can move longitudinally within the rocker lower portion side openings 61*a*. Further, the terminal contact support 68 is biased away from the rocker 32 by the biasing spring 72. An end of the biasing spring 72 overlies a nub 92 (FIGS. 7 and 8) extending downwardly from a bottom surface of the rocker upper portion 55. When the rocker 32 pivots, the terminal contact support 68 also pivots as seen in FIG. 8.

As the terminal contact support 68 pivots with the rocker 32, the terminal bridging contact 70 moves substantially horizontally to bridge the center terminal 76 and one of the outer terminals 78, 80 depending on which off center position the rocker is pivoted to. In FIG. 8, the center terminal 76 and the outer terminal 80 are bridged. The biasing spring 72 biases the terminal contact support 68 downwardly with respect to the rocker 32. This downward biasing, in turn, forces the terminal bridging contact 70 against terminal upper surfaces 76*a*, 78*a*, 80*a* and causes the terminal bridging contact 70 to translate horizontally across the terminal upper surfaces even though the terminal contact support 68 moves in an arcuate path.

The horizontal movement of the terminal bridging contact 70 provides a more positive electrical connection between the bridged terminals 76, 78 or 76, 80, (depending on the off center position the rocker 32 is pivoted to). Additionally, the movement of the terminal bridging contact 70 across the terminal upper surfaces 76*a*, 78*a*, 80*a* provides a cleaning action removing contaminants from the contact surfaces of the terminals 76, 78, 80 and the terminal bridging contact 70.

Referring to FIG. 8, the application of a force F to the rocker upper portion 55 causes the rocker 32 to pivot to the off center position shown. The biasing coil spring 39*b* is compressed. When the force F is removed, the coil spring 39*b* returns the rocker 32 to the center position (FIG. 7) where the forces exerted by each spring 39*a*, 39*b* are in equilibrium. Of course, it should be understood that if the force F is applied to pivot the rocker to the other off center position, the coil spring 39*a* will be compressed and will return the rocker to the center position when the force F is removed.

The terminals 76, 78, 80 are press fit into slotted openings 94 (FIG. 4) extending through the terminal frame 74. The terminal frame 74 includes extensions 96 (FIGS. 4, 7 and 8) which snap fit into corresponding openings 98 (FIGS. 4 and 6) to secure the terminal frame to the rocker support housing 34. Ends of conductive leads or wires (not shown) are soldered near outwardly extending ends 76*b*, 78*b*, 80*b* (FIGS. 7 and 8) of the terminals 76, 78, 80. The wires exit the outer housing 16 through the longitudinal openings 24. The downwardly facing side 100 (FIGS. 7 and 8) of the terminal frame 74 defines a recessed region which is filled with a potting compound (not shown). Preferably, the potting compound is polyurethane. A lower portion 102 (FIGS. 7 and 8) of the outer housing interior region is also filled with potting compound. The potting compound, in conjunction with the boot 40, completes the seal of the rocker supporting housing 34 preventing contaminants from entering the housing interior region 34*a* and potentially corroding or short circuiting the terminal bridging contact 70 and the terminal upper surfaces 76*a*, 78*a*, 80*a*. The openings 24 are sized to snugly fit the wires. The snug fit prevents the potting compound from being forced out of the openings 24 and provides support for the wires.

The present invention has been described with a degree of particularity, but it is the intent that the invention include all modifications from the disclosed preferred design failing within the spirit or scope of the appended claims.

We claim:

1. A trim switch comprising:

a) an outer housing defining an interior region; and b) a rocker assembly, a least of portion of which is sized to fit within the outer housing interior region, the rocker assembly including;

i) a rocker support housing defining an interior region;

ii) a rocker mounted on the rocker support housing, the rocker pivotable between a plurality of positions;

iii) a terminal assembly supported by the rocker support housing, the terminal assembly including a plurality of terminals;

iv) a terminal bridging assembly supported within the rocker support housing interior region for pivoting movement with the rocker, the terminal bridging assembly including a terminal bridging contact bridging two terminals in at least one of the rocker positions; and v) a flexible, waterproof boot overlying at least a portion of the rocker assembly and disposed between the outer housing and the overlied portion of the rocker assembly to prevent contaminants from entering the rocker support housing interior region, the overlied portion of the rocker assembly including the rocker and at least a portion of the rocker support housing adjacent the rocker.

2. The trim switch of claim 1 wherein the boot is cup-shaped and is comprised of SANTOPRENE™.

3. The trim switch of claim 1 wherein the rocker support housing further supports a resiliently deformable member disposed between the rocker and the rocker support housing, the member biasing the rocker to a central position.

4. The trim switch of claim 3 wherein the resiliently deformable member includes a pair of coil springs disposed between the rocker and the rocker support housing.

5. The trim switch of claim 1 wherein the terminal bridging contact moves substantially horizontally to bridge two terminals when the rocker is moved to an off center position.

6. The trim switch of claim 1 wherein the terminal bridging assembly includes a terminal contact support which slidingly interfits in a central opening of a lower portion of the rocker for pivoting movement with the rocker.

7. The trim switch of claim 6 wherein the terminal bridge assembly further includes a biasing spring disposed between the rocker and the terminal contact support to bias the terminal bridging contact against an upper surface of terminals contacted by the terminal bridging contact.

8. The trim switch of claim 1 wherein the rocker support housing further includes a plurality of legs extending from the rocker support housing which fit into corresponding openings in the outer housing to secure the rocker support housing to the outer housing.

9. The trim switch of claim 1 wherein the terminal assembly includes a terminal frame for supporting the plurality of terminals and the terminal frame includes a plurality of extensions extending from the terminal frame which fit into corresponding openings in the rocker support housing to secure the terminal frame to the rocker support housing.

10. A trim switch comprising:

a) a protective boot having an open end and at least a portion of which is sized to fit within an interior region of an outer housing and to overlie at least a portion of a rocker assembly;

b) the rocker assembly including a rocker support housing, a rocker pivotably supported by the rocker support housing, the rocker support housing defining an interior region in which a terminal assembly is disposed;

c) the terminal assembly including a plurality of spaced apart terminals and a terminal bridging contact movable between a plurality of positions, the terminal bridging contact being supported by and movable with the rocker and bridging two terminals of the plurality of terminals in at least one of the plurality of positions;

d) the protective boot overlying the rocker and at least a portion of the rocker support housing adjacent the rocker to prevent moisture from entering the rocker support housing interior region through an opening between the rocker and the portion of the rocker support housing adjacent the rocker; and e) the plurality of terminals being accessible through the open end of the boot and an opening in the outer housing.

11. The trim switch of claim 10 wherein the boot is cup-shaped and is comprised of SANTOPRENE™.

12. The trim switch of claim 10 wherein the rocker support housing further supports a resiliently deformable member disposed between the rocker and the rocker support housing, the member biasing the rocker to a central position.

13. The trim switch of claim 12 wherein the resiliently deformable member includes a pair of coil springs disposed between the rocker and the rocker support housing.

* * * * *